US005356674A

United States Patent [19]

Henne et al.

[11] Patent Number: 5,356,674

[45] Date of Patent: Oct. 18, 1994

[54] PROCESS FOR APPLYING CERAMIC COATINGS USING A PLASMA JET CARRYING A FREE FORM NON-METALLIC ELEMENT

[75] Inventors: Rudolf Henne, Boeblingen; Winfried Weber, Leinfelden-Echterdingen; Guenter Schiller, Gerlingen; Werner Schnurnberger, Stuttgart; Michael Kabs, Hanau, all of Fed. Rep. of Germany

[73] Assignees: Deutsche Forschungsanstalt fuer Luft-Raumfahrt e.V., Bonn; W. C. Heraeus GmbH, Hanau, both of Fed. Rep. of Germany

[21] Appl. No.: 41,122

[22] PCT Filed: Apr. 26, 1990

[86] PCT No.: PCT/EP90/00674

§ 371 Date: Feb. 19, 1991

§ 102(e) Date: Feb. 19, 1991

[87] PCT Pub. No.: WO90/13681

PCT Pub. Date: Nov. 15, 1990

Related U.S. Application Data

[63] Continuation of Ser. No. 870,788, Apr. 16, 1992, abandoned, which is a continuation of Ser. No. 635,165, Feb. 19, 1991, abandoned.

[30] Foreign Application Priority Data

May 4, 1989 [DE] Fed. Rep. of Germany ..... 3914722

[51] Int. Cl.[5] ..... B05D 5/12

[52] U.S. Cl. ..... 427/449; 427/453; 427/540; 427/576; 427/579; 427/580; 427/600; 427/189

[58] Field of Search ..... 427/449, 453, 540, 576, 427/579, 580, 600, 189

[56] References Cited

U.S. PATENT DOCUMENTS 3,640,757 2/1972 Grubba .
3,814,620 6/1974 Bailey et al. ..... 427/34
4,050,408 9/1977 Beucherie .
4,741,286 5/1988 Itoh et al. ..... 427/34
4,853,250 8/1989 Boulos et al. ..... 427/34
4,897,282 1/1990 Kniseley et al. ..... 427/34

FOREIGN PATENT DOCUMENTS 0202077 of 0000 European Pat. Off. .
0330196 2/1988 European Pat. Off. ..... C23C 4/10
0288711 11/1988 European Pat. Off. ..... H01L 39/24
1174345 of 0000 Fed. Rep. of Germany .

(List continued on next page.)

OTHER PUBLICATIONS

I. A. Fisher, "Variables Influencing the Characteristics of Plasma-Sprayed Coatings", *International Metallurgical Reviews*, vol. 17, Review 164, pp. 117-129, Jun. 1972.
E. Kretzschmar, "Metallkeramik und Plasmaspritzen", *VEB Verlag Technik*, p. 290, 1963.

(List continued on next page.)

*Primary Examiner*—Shrive Beck
*Assistant Examiner*—Benjamin L. Utech
*Attorney, Agent, or Firm*—Barry R. Lipsitz

[57] ABSTRACT

Process for applying a coating of ceramic material on a substrate by plasma spraying. The material to be sprayed, which is incorporated in the plasma jet, includes a chemical compound one constituent of which is a non-metallic element from the group N, C, B or from main groups VI or VII of the periodic classification, which decomposes, at least partially, in an inert environment before reaching the melting point and which is present in the solid phase in the applied state. To improve the process so that the chemical compound contained in the material can be applied to the substrate stoichiometrically, i.e., undecomposed, and form an impermeable, adherent, stable coating, the non-metallic element is incorporated in the plasma jet, in addition to the material to be sprayed, in a free form, not bound to a foreign element.

45 Claims, 2 Drawing Sheets

FOREIGN PATENT DOCUMENTS

| | | |
|---|---|---|
| 3024611 | of 0000 | Fed. Rep. of Germany . |
| 3538390 | of 0000 | Fed. Rep. of Germany . |
| 3721008 | of 0000 | Fed. Rep. of Germany . |
| 2038894 | 2/1972 | Fed. Rep. of Germany ..... C23C 15/00 |
| 2155217 | 10/1973 | Fed. Rep. of Germany . |
| 1429278 | of 0000 | France . |
| 2104023 | of 0000 | France . |
| 144426 | of 0000 | German Democratic Rep. . |
| 1182242 | of 0000 | United Kingdom . |

OTHER PUBLICATIONS

K. Tachikawa, "High $T_c$ Superconducting Films of Y-Ba-Cu Oxides Prepared by Low-Pressure Plasma Spraying", *Applied Physics Letters,* vol. 52, pp. 1011-1013, Mar. 1988.

G. M. Herterick, "Gas Selection in Plasma Spraying", *Welding Journal,* vol. 66, No. 2, pp. 27-30, Feb. 1987.

Japanese Patent Application Abstract, Application No. 63-125653, *Patent Abstracts of Japan,* vol. 12, No. 373, Oct. 6, 1988.

PROCESS FOR APPLYING CERAMIC COATINGS USING A PLASMA JET CARRYING A FREE FORM NON-METALLIC ELEMENT

This application is a continuation of commonly assigned, copending U.S. patent application Ser. No. 07/870,788 filed Apr. 16, 1992, which is a continuation of Ser. No. 07/635,165 filed Feb. 19, 1991, now abandoned.

BACKGROUND OF THE INVENTION

The invention relates to a process for applying a coating of ceramic material to a substrate by plasma spraying wherein the material is added to the plasma jet and includes a chemical compound, one constituent of which is a non-metallic element from the group N, C, B or from the main groups VI or VII of the Periodic Table which decomposes at least partially before reaching the melting point and is present in the solid phase in the applied state.

Such a process is known from DE-OS 30 24 611. Herein, iron spinel and cobalt spinel are applied by plasma spraying at low torch power. In view of the low torch power, it is to be assumed that only the iron spinel will melt as it has a low melting point, while the cobalt spinel will only be embedded in the molten iron spinel. Furthermore, decomposition products of the cobalt spinel will presumably be present in spite of the low torch power.

With plasma spraying at low torch power, the bonding of the applied coating to the substrate is not optimum and the internal solidity of the outer coating is also limited. Furthermore, the coating yield is also very low for when the material to be sprayed is hurled in the still solid state by the plasma jet against the substrate, an impact reflection occurs at the substrate and hence only a small part of the material to be sprayed remains adhering to the substrate.

The object underlying the invention is, therefore, to so improve a process of the generic kind that the chemical compound contained in the material can be applied stoichiometrically, i.e., undecomposed to the substrate and forms an impermeable, adherent and stable coating.

SUMMARY OF THE INVENTION

This object is accomplished in accordance with the invention in a process of the kind described at the beginning in that in addition to the material to be sprayed, the non-metallic element is carried along in the plasma jet in a free form not bound to a foreign element. In this way, by addition of the element, the reaction balance of the compound tending to decompose is shifted to the undecomposed compound and so this compound can be heated to sufficiently high tempertures in the plasma jet and hence form on contacting the substrate an impermeable, adherent and stable coating which, in addition, contains the chemical compound essentially in undecomposed form.

It has proven particularly advantageous within the scope of the inventive process for a laminar jet generated by a plasma torch with a nozzle generating a laminar jet to be used as a plasma jet as this laminar jet offers the best preconditions for the material to be sprayed to be heated constantly and uniformly and for an adequate time in order to achieve as uniform a coating as possible on the substrate.

It is particularly expedient for the length of the laminar jet to be at least 60 mm from the nozzle on. Even better results are obtained with 80 mm and very good results with a laminar jet length of 100 mm. Optimum results are to be achieved with a laminar jet length of 150 mm.

It has, furthermore, proven particularly expedient within the scope of the inventive solution for the latter to be carried out in a vacuum as problems otherwise arise from impurities or interactions owing to the atmosphere surrounding the plasma jet.

It is preferable to use as the plasma jet that of a d.c. plasma torch with which a plasma jet having as constant a temperature as possible and as constant a flow profile as possible can be generated.

To shift the reaction balance in the direction towards the undecomposed chemical compound, it is particularly advantageous for the non-metallic element to be carried along in the plasma jet in dissociated or atomic form.

In the examples of the inventive process described so far, no details were given as to how the non-metallic element is conducted in the plasma jet. It is expedient for the non-metallic element to be conducted, after its introduction, in the core region near the axis of the plasma jet so there is as intensive an interaction as possible with the plasma jet surrounding it but, at the same time, also good shielding by the plasma jet surrounding it.

The reaction balance can be shifted particularly well in an inventive way by the non-metallic element being carried along in ionized form in the plasma jet.

In principle, within the scope of the inventive process, the non-metallic element could be added to the plasma jet, for example, with the plasma gas flow. However, this would require electrode materials which are not affected by the non-metallic element. For this reason, it is more advantageous for the non-metallic element to be added to a primary plasma jet downstream from the high-current arc.

However, in order to heat the non-metallic element as strongly as possible and hence carry it along at least in dissociated, if not in ionized form in the plasma jet, it has proven expedient for the non-metallic element to be added to the plasma jet on the side thereof facing the high-current arc and near the latter.

The dissociation or ionization of the non-metallic element in the plasma jet is particularly easily achieved and maintained by it being brought about by interaction with the primary plasma jet.

Introduction of the non-metallic element into the plasma jet can be achieved in a structurally simple way by the non-metallic element being added to the plasma jet in the nozzle of the torch generating the laminar jet.

An embodiment of the inventive process has proven particularly suitable wherein the non-metallic element is added to the plasma jet in a Laval nozzle serving as nozzle for generating the laminar jet.

In a particularly simple embodiment, provision is made for the non-metallic element to be added to the plasma jet together with the material to be sprayed so no additional apparatus is necessary for adding the non-metallic element to the plasma jet and the apparatus normally suitable for the plasma spraying can be used.

Within the scope of the inventive solution, an embodiment is particularly preferred wherein the non-metallic element is introduced into the plasma jet in gaseous form as good, uniform distribution and easy dissociation or ionization of the non-metallic element are thereby possible.

Hence it is, for example, expedient for the non-metallic element to be introduced into the plasma jet by a gas which liberates it.

Since the material serving as material to be sprayed is usually present in solid form and hence has to be added to the plasma jet by a conveying medium, provision is made in a preferred solution for the non-metallic element to be included in a conveying medium for the material to be sprayed.

Herein, it has proven expedient for the conveying medium for the material to be sprayed to be gaseous.

Within the scope of the embodiments described hereinabove, provision is expediently also made for the material to be sprayed to be present in powder form.

Within the scope of the embodiments described so far, no details were given as to how the material to be sprayed is conducted in the plasma jet. It is particularly advantageous for the material to be sprayed to be conducted, after its introduction, in the core region near the axis of the plasma jet so it is, on the one hand, heated as uniformly as possible by the plasma jet surrounding it and, on the other hand, is also protected.

Similarly, no details were given as to how the material to be sprayed is introduced into the plasma jet. It has likewise proven expedient for the material to be sprayed to be added to a primary plasma jet downstream from the high-current arc.

This is preferably carried out by the material to be sprayed being added to the primary plasma jet on its side facing the high-current arc and near the latter.

In a particularly preferred embodiment of the inventive process, provision is made for the material to be sprayed to be added to the plasma jet in the nozzle of the torch for generating the laminar jet.

Particularly good results are obtained when the material to be sprayed is added to the plasma jet in a Laval nozzle serving as nozzle for generating the laminar jet.

Since relatively high temperatures are usually present in the plasma jet, undesired reactions of the non-metallic carried along in it can also occur very easily therein. For this reason, provision is expediently made for the plasma jet to be essentially free from chemical elements which react with the non-metallic element to form stable chemical compounds. In particular, it is expedient for the plasma jet to be substantially free of hydrogen.

Regarding the type of the plasma gas, provision is expediently made for this to include an inert gas.

In a preferred embodiment, provision is made for the primary plasma gas to include argon, with a major constituent thereof preferably consisting of argon.

In addition, provision is expediently made for the primary plasma gas to include in addition to the argon additional gases which increase enthalpy and toughness, with these serving to provide the necessary energy, on the one hand, for heating the material to be sprayed and, as the case may be, for the dissociation or ionization of the non-metallic element.

Advantageous values for the enthalpy of the primary plasma are enthalpies of >20 MJ/kg at 10,000 degrees C., it is even better for the enthalpy to be >30 MJ/Kg at 10,000 degrees and optimum values are obtained when the enthalpy is >40 MJ/Kg at 10,000 degrees C.

A further preferred inert gas is helium.

In a preferred embodiment of the present invention, provision is made for helium as additional gas increasing the free enthalpy to be added to the argon as main plasma gas.

Another advantageous possibility is to add nitrogen instead of helium as additional gas increasing the free enthalpy to the argon as main plasma gas.

To ensure that the non-metallic element is present in a sufficiently high concentration to carry out the inventive process, provision is preferably made for the gaseous, non-metallic element to be carried along in the plasma jet in a proportion of more than 5% of the gases included therein.

It is even better for this proportion to be more than 15% of the gases included in the plasma jet.

To ensure that the non-metallic element is present in the plasma jet in dissociated form, provision is made for the plasma jet to have an enthalpy and temperature bringing about dissociation of the non-metallic element.

If the non-metallic element is also to be present in ionized form, it is even better for the plasma jet to have a temperature and free enthalpy bringing about ionization of the non-metallic element.

If a sufficiently high temperature of the plasma jet cannot be achieved with the plasma torch itself, it is advantageous for heating to be provided in addition for the plasma jet following the high-current arc. In particular, it is expedient for the additional heating to be carried out by high-frequency coupling into the plasma jet, with this being inductive or capacitive coupling-in.

So far, no further details were given as to the composition of the chemical compound. A chemical compound including a metal as further chemical element has proven particularly suitable for use of the inventive process. Preferred materials are oxidized materials, for example, spinels and perovskites on a nickel or cobalt or nickel-cobalt basis. It is, however, also conceivable to apply all possible kinds of spinels and perovskites in accordance with the inventive process. This also applies to spinel-like and perovskite-like compounds and to non oxidized compounds, for example, nitrides, halides, carbides, etc., with nitrogen or halogens or also non-metallic compounds, methane or acetylene then being carried along as non-metallic element by the plasma jet.

All these compounds are preferably characterized by the chemical compound exhibiting in the region of its melting temperature a free enthalpy of formation lying in the region of zero or above, i.e., it is a chemical compound which has an increasing tendency to decompose as the temperature rises.

Sufficient and uniform heating of the chemical compound which is required for good formation of the coating on the substrate is advantageously achieved by the chemical compound interacting with the laminar plasma jet within the latter over a length of at least 60 mm. Even better values are obtained when the length of the interaction is at least 80 mm, very good values when the length of the interaction is at least 100 mm and optimum values when the length of the interaction is at least 150 mm.

To obtain a coating which adheres well on the substrate, it is necessary, as mentioned at the beginning, to heat the material to be sprayed to as high a temperature as possible, for example, above the melting point, but there must still not be any noticeable vaporization of the material. For this reason, it is advantageous for the chemical compound to be heated to at least approximately 500 degrees C. in the plasma jet. It is even better for the chemical compound to be heated to at least 1,000 degrees C. or even better to at least 1,500 degrees C. or best of all to at least 2,000 degrees C.

The best adhering properties of the coatings are achieved when the chemical compound is heated in the plasma jet to at least a temperature in the region of its melting point.

The best results are obtained when the chemical compound is heated to at least a temperature corresponding to its melting point.

Particularly good results are obtained with the inventive process when the chemical compound is moderately heated in the plasma jet, this meaning that the chemical compound is heated to a surface temperature of between 0 and 1000 degrees C., preferably 0 and 500 degrees C. above its melting point, i.e., there is no strong heating beyond the melting point.

The inventive process is used particularly when the material serves as catalytically active coating.

In a further embodiment, the material serves as electrocatalytically active coating.

In other preferred embodiments within the scope of the inventive process, the material serves as tribologically effective coating.

In a further embodiment, the material serves as superconductive coating.

Particularly good results are achieved within the scope of the present invention when the plasma spraying is carried out with an ultrasonic jet as coatings which adhere very firmly to the substrate are thereby obtained.

BRIEF DESCRIPTION OF THE DRAWINGS

Further features and advantages of the present invention are the subject matter of the following description in conjunction with the drawings. The drawings show:

FIG. 2 an X-ray diffractogram wherein

DETAILED DESCRIPTION OF THE INVENTION

Figure 1:
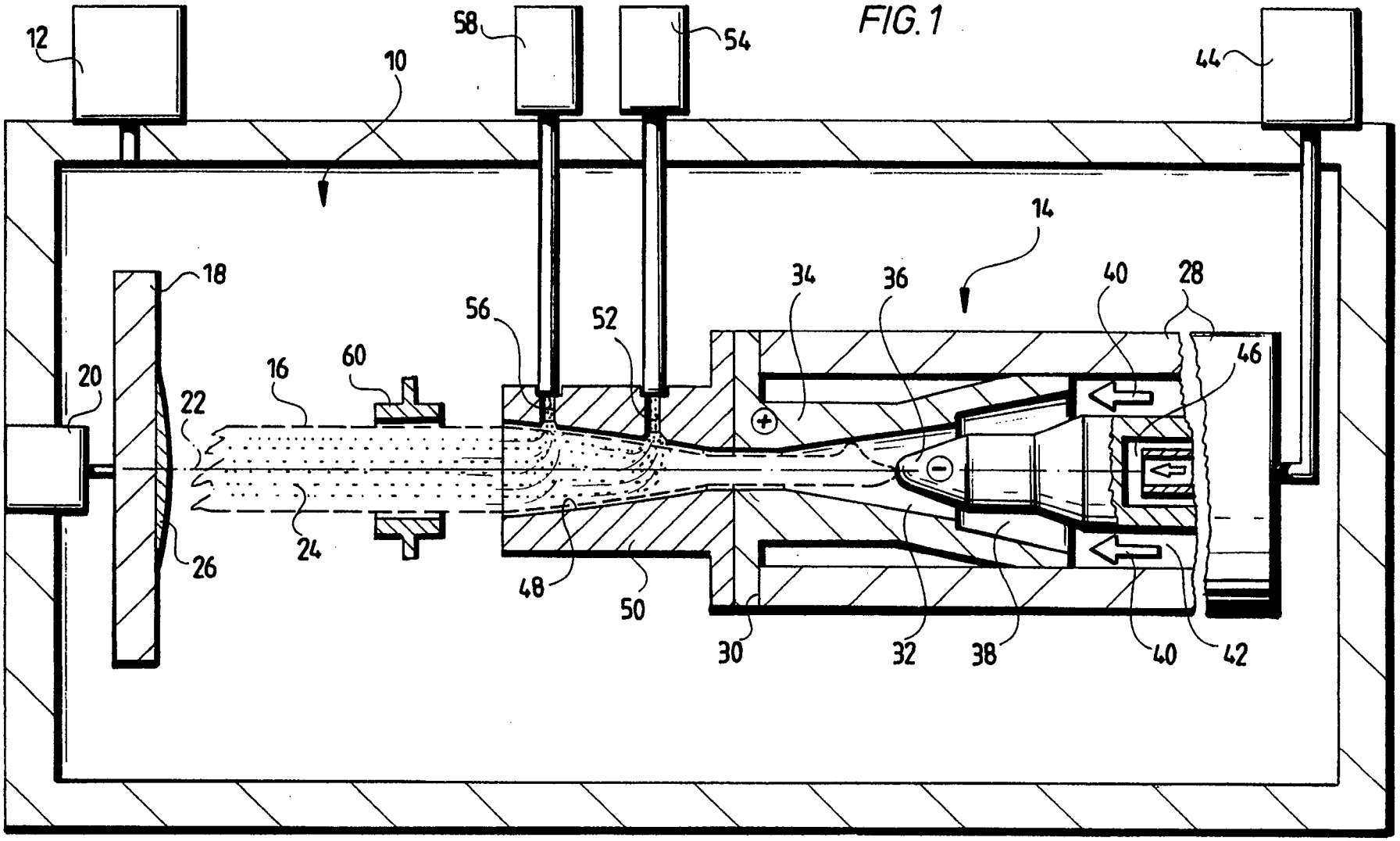
FIG. 1 a schematic illustration of an apparatus for carrying out the inventive process.

An apparatus for performing the inventive process comprises-as illustrated schematically in FIG. 1-a vacuum chamber 10 which is evacuatable to a preselectable pressure by a vacuum pumping system 12. There is, furthermore, arranged in this vacuum chamber 10 a plasma torch 14 which generates a plasma jet 16 which strikes a substrate 18 likewise arranged in the vacuum chamber 10 and, for its part, moveable by a moving device 20 relative to the plasma jet 16 in a plane extending perpendicular to a longitudinal axis 22 of the plasma jet 16. A jet 24 of material to be sprayed consisting of particles of a material to be applied is carried along in this plasma jet 16 and on striking the substrate 18, produces a coating 26 of this material.

The plasma torch 14 operates as a d.c. torch and, for its part, comprises a tube-like housing 28 in which a sleeve-shaped anode 34 comprising a gas channel 32 tapering conically towards an end 30 of the housing 28 facing the substrate 18 is arranged. A pin-shaped cathode 36 protrudes from a rear side opposite the end 30 into the gas channel 32, with there remaining between the anode 34 and the cathode 36 a ring gap 38 through which a plasma gas flow 40 can enter the gas channel 32. The plasma gas flow 40 is supplied to this ring gap 38 via a ring space 42 between the cathode 36 and the housing 28. The gas is supplied to this ring space 42 in a manner known per se via a plasma torch supplying device designated in its entirety 44 which also provides the necessary d.c. voltage between the anode 34 and the cathode 36 and, in addition, supplies a cooling channel 46 in the cathode 36 with coolant.

The gas channel 32 of the anode continues towards the substrate 18 in a nozzle channel 48 of a Laval nozzle 50 which immediately adjoins the anode 34 and from which, with the proper choice of parameters, the substantially parallel, laminar plasma jet 16 exits. The Lavel nozzle 50 and the gas channel 32 are arranged coaxially with the longitudinal axis 22 of the plasma jet 16.

There is at least one first inlet channel 52 opening into the nozzle channel 48 of the Laval nozzle 50 for supplying the material to be sprayed forming the jet 24 of material to be sprayed. The inlet channel 52 is supplied via a first feed means 54. It is, however, additionally possible to provide on the side of the first inlet channel 52 facing the substrate 18 a second inlet channel 56 which is supplied via a second feed means 58.

The plasma spraying with a plasma torch 14 in the vacuum chamber 10 is well known, as described in detail for example in DE-OS 35 38 390. Furthermore, a detailed illustration of the function and mode of operation of the plasma torch can be found in the article by W. Mayr and R. Henne "Investigation of a VPS burner with laval nozzle by means of an automated laser doppler measuring equipment" Proc. 1st Plasma Technology Symposium, Lucerne, 1988.

The inventive process will be described in detail hereinbelow with reference to cobalt spinel ($Co_3O_4$). This cobalt spinel is applied as a coating to a substrate. The cobalt spinel may, for example, be supplied via the first feed means 54 and the first inlet channel 52. The cobalt spinel is present in powder form and is conveyed by a carrier gas from the first feed means 54 to the first inlet channel 52 and from there into the Laval nozzle. A gas mixture consisting of 80% $O_2$ and 20% Ar is preferably used as a carrier gas for the cobalt spinel in powder form. This oxygen ($O_2$) constitutes the non-metallic element in free form, not bound to a foreign element, which is carried along in addition to the material to be sprayed in the plasma jet 16.

The torch is operated with a primary plasma gas flow which preferably includes argon as the main gas. To increase the enthalpy, helium can be added thereto. It is also possible to add nitrogen to increase the enthalpy.

The plasma torch 14 is preferably operated such that a long, laminar plasma jet extending parallel to the longitudinal axis 22 is formed with a length of at least 150 mm. In vacuum, its speed may be from 2,000 to 3,000 meters per second. In addition, the material to be sprayed, i.e. the cobalt spinel is to be supplied such that an axially close jet 24 of material to be sprayed extending near the longitudinal axis 22 is likewise formed in the core region of the plasma jet, with speeds of the material to be sprayed of up to approximately 1,000 m/sec then prevailing and this jet 24 of material to be sprayed being protected by the part of the plasma jet 16 surrounding it. The time spent by the material to be sprayed in the plasma jet 16 between its injection into the Laval nozzle 50 and its striking the substrate 18 is then less than $10^{-3}$ seconds, with interaction with the plasma jet occurring over a length of more than 150 mm.

During this short time spend by the material to be sprayed in the plasma jet 16, the material to be sprayed is heated up in accordance with the invention to the region of the melting temperature, with melting of the material to be sprayed preferably taking place so it is present in the molten state during the time spent in the plasma jet 16. It is expedient for the material to be sprayed to be heated up only moderately to a surface temperature in the range of from 0 to 1,000 degrees above it melting point.

Owing to the short time spent by the material to be sprayed in the plasma jet, the time available to the material to be sprayed for decomposition is kept very short. In addition, the oxygen carried along by the plasma jet in the inventive manner during the plasma spraying of cobalt spinel counteracts the decomposition of the cobalt spinel as it shifts the dissociation or decomposition balance towards the undecomposed cobalt spinel.

The power of the plasma torch 14 is preferably such that the plasma in the plasma jet is sufficiently hot and rich in enthalpy to dissociate and ionize the oxygen supplied downstream from the plasma jet 16 and hence especially to shift the reaction balance of the cobalt spinel towards the oxide, i.e., towards the undecomposed cobalt spinel or to carry out a reoxidation of any oxides which may have become unstoichiometric. It is preferable to work with an enthalpy of the plasma of more than 40 MJ/kg at 10,000 degrees C.

In the inventive process, in particular to increase the enthalpy of the plasma torch 14, there must be no addition of hydrogen to the plasma gas flow as this would react with the oxygen supplied via the carrier gas to form water.

Figures 2A, 2B, 2C, 2D:
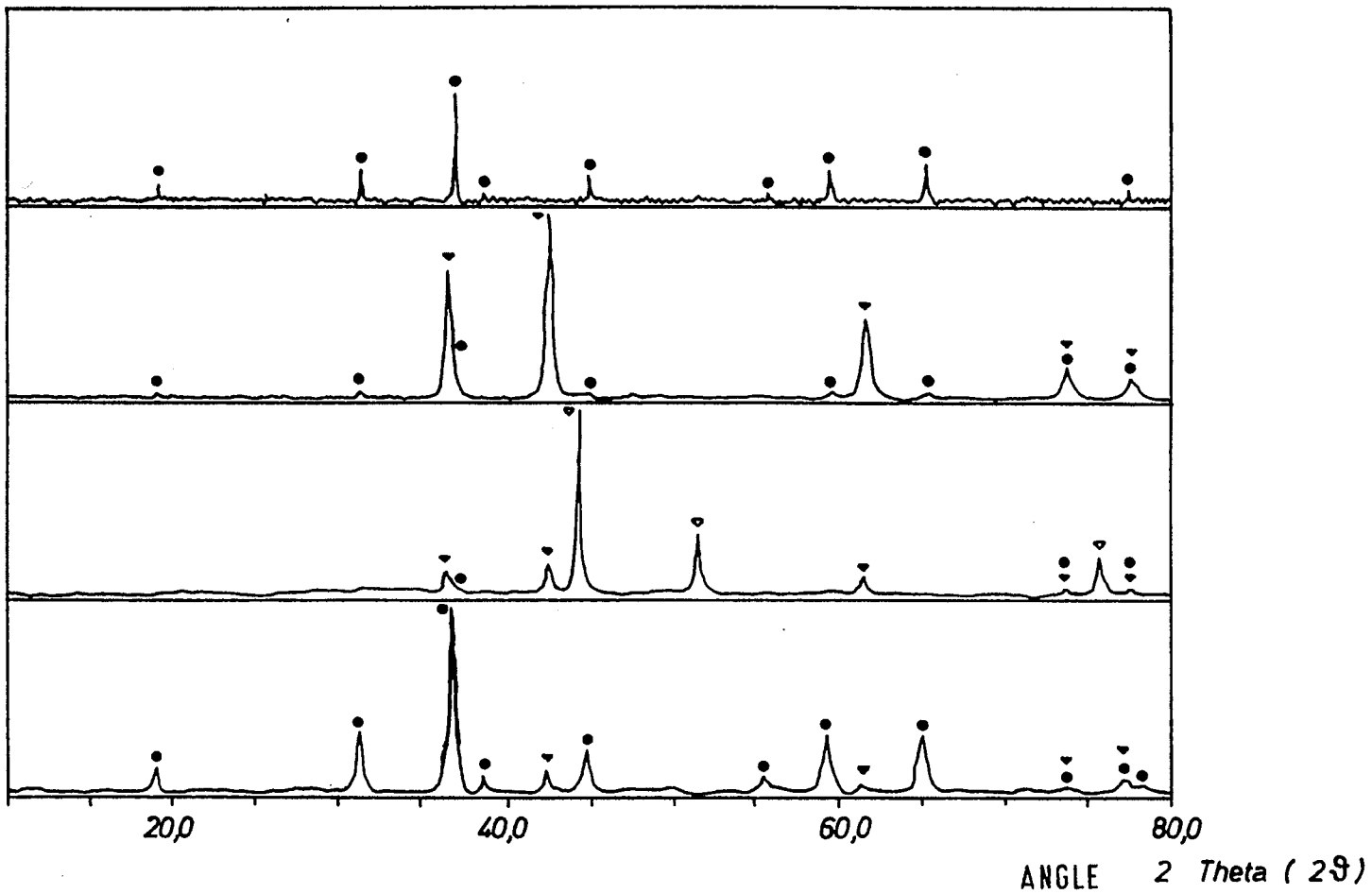
FIG. 2*a* shows the X-ray diffractogram of cobalt spinel powder produced at 400 degrees.
FIG. 2*b* the X-ray diffractogram of an applied coating of cobalt spinel with argon as plasma gas and argon as carrier gas for the material to be sprayed.
FIG. 2*c* the X-ray diffractogram of an applied coating of cobalt spinel with argon and hydrogen as plasma gas and argon as carrier gas for the material to be sprayed.
FIG. 2*d* the X-ray diffractogram of an applied coating with argon plus helium as plasma gas and argon and oxygen as carrier gas for the material to be sprayed.

The advantages of the inventive process become particularly clear from a comparison of a coating 26 applied by the inventive process with processes in which no oxygen is carried along in the plasma jet 16. FIG. 2*d* shows an X-ray diffractogram of cobalt spinel applied by the inventive process wherein it is clearly evident that essentially the reflexes of cobalt spinel (characterized by ●) prevail, whereas in the processes in which no oxygen was carried along in the plasma jet 16 (FIGS. 2*b* and 2*c*) clearly the reflexes of CoO (characterized by ▼) and Co (characterized by ▽) predominate over the reflexes of cobalt spinel (●, which clearly proves that the inventive process prevents the decomposition of cobalt spinel in the plasma spraying.

The cobalt spinel coating, the X-ray diffractogram of which is shown in FIG. 2*d*, was achieved with the following parameters: Power of the plasma torch 14, 30 kW, pressure in the vacuum chamber 10, 50 mbar, plasma gas consisting of argon and helium and carrier gas for the cobalt spinel in powder form of 80% $O_2$ and 20% Ar. The thickness of the coating was 200 μm and exhibited a very dense structure and was firmly bonded to nickel as the substrate. The preferred order of magnitude for the coating growth is 10 μm/sec in relation to a coating area of 10 $cm^2$ and so by subjecting the substrate to controllable, thermal action, the desired coating can be applied in one work cycle without, for example, subsequent treatment being necessary.

In a modification of the embodiment of the inventive process described hereinabove, it is, however, also possible to add the material to be sprayed to the plasma jet 16 via the second feed means 58 and the second inlet channel 56, with only argon serving as carrier gas and the oxygen being added separately via the first feed means 54 and the first inlet channel 52, i.e. on the "hotter" side of the plasma jet as the oxygen requires very high temperatures for the dissociation and ionization, while the temperatures for the material to be sprayed can be chosen lower, particularly when this is not cobalt spinel but a material with a lower melting temperature.

As an alternative to this, it is likewise possible to supply two different materials via the first feed means 54 and via the second feed means 58, with the non-metallic element being supplied in the carrier gas of either the one or the other or a non-metallic element suitable for the respective material in both.

In a further modification of the inventive process, provision is made, in the event the plasma torch 14 does not generate sufficient temperatures and enthalpies, for the plasma flow 16 to be heated up by an additional heating 60 downstream from the Laval nozzle, with this heating being, for example, in the form of a device for coupling high frequency into the plasma jet 16 and this being carried but capacitively or inductively.

We claim:

1. A process for applying a coating of ceramic material to a substrate by plasma spraying, wherein a material forming the coating of ceramic material is added to a plasma jet as a material to be sprayed, comprising the steps of:

providing a plasma torch;

introducing a primary plasma gas comprising argon and additional gas other than argon for increasing enthalpy to said plasma torch to produce a plasma jet having an enthalpy of more than 20 MJ/kg at 10,000° C.;

providing a material to be sprayed, said material including a chemical compound having the property of decomposing at least partially when heated in an inert environment before reaching its melting point, providing a non-metallic element from the group N, C, B or from the main groups VIa or VIIa of the Periodic Table, introducing said material to be sprayed and said non-metallic element into said plasma jet downstream of a high-current arc of said plasma torch, wherein said plasma jet heats said non-metallic element to a free dissociated or ionized form not bound to a foreign element;

heating said material to be sprayed in said plasma jet to a temperature of at most 1000 degrees C. above the melting point of said chemical compound and;

spraying said material to be sprayed, with said plasma jet, onto said substrate.

2. A process as defined in claim 1, characterized in that a nozzle for generating a laminar jet as said plasma jet is provided downstream of said high current arc.

3. A process as defined in claim 2, characterized in that said plasma jet is generated by a d.c. torch.

4. A process as defined in claim 3, characterized in that said non-metallic element is added to said plasma jet downstream from said high-current arc.

5. A process as defined in claim 4, characterized in that said non-metallic element is added to said plasma jet downstream of said high-current arc, and closer to said arc than to said substrate.

6. A process as defined in claim 2, characterized in that said non-metallic element is conducted, after its introduction, in the core region of said plasma jet.

7. A process as defined in claim 2, characterized in that said non-metallic element is added to said plasma jet in the nozzle of said torch generating said laminar jet.

8. A process as defined in claim 7, characterized in that said non-metallic element is added to said plasma jet in a Laval nozzle serving as the nozzle generating said laminar jet.

9. A process as defined in claim 2, characterized in that said chemical compound interacts with said laminar plasma jet over a length of at least 60 mm.

10. A process as defined in claim 1, characterized in that said plasma spraying is carried out in a vacuum.

11. A process as defined in claim 1, characterized in that said non-metallic element is carried along in dissociated form in said plasma jet.

12. A process as defined in claim 1, characterized in that said non-metallic element is carried along in ionized form in said plasma jet.

13. A process as defined in claim 1, characterized in that said non-metallic element is added to said plasma jet together with said material to be sprayed.

14. A process as defined in claim 1, characterized in that said non-metallic element is introduced into said plasma jet in gaseous form.

15. A process as defined in claim 1, characterized in that said non-metallic element is liberated from a gas introduced into said plasma jet.

16. A process as defined in claim 1, characterized in that said non-metallic element is included in a conveying medium for said material to be sprayed.

17. A process as defined in claim 16, characterized in that said conveying medium for said material to be sprayed is gaseous.

18. A process as defined in claim 1, characterized in that said material to be sprayed which is added to said plasma jet is in powder form.

19. A process as defined in claim 1, characterized in that said material to be sprayed is conducted, after its introduction, in the core region of said plasma jet.

20. A process as defined in claim 1, wherein a nozzle is provided downstream of said high current arc, and said material to be sprayed is added to said plasma jet in said nozzle.

21. A process as defined in claim 20, wherein said nozzle is a Laval nozzle which forms said plasma jet into a laminar jet.

22. A process as defined in claim 1, characterized in that said plasma jet is essentially free of chemical elements which could react with said non-metallic element to form stable chemical compounds.

23. A process as defined in claim 22, characterized in that said plasma jet is essentially free of hydrogen.

24. A process as defined in claim 1, characterized in that said primary plasma gas exhibits an enthalpy of >30 MJ/Kg at 10,000 degrees C.

25. A process as defined in claim 24, characterized in that said primary plasma gas exhibits an enthalpy of >40 MJ/Kg at 10,000 degrees C.

26. A process as defined in claim 1, characterized in that said plasma gas includes helium.

27. A process as defined in claim 1, characterized in that helium or nitrogen is added as additional gas increasing the free enthalpy and the viscosity of the primary plasma gas.

28. A process as defined in claim 1, characterized in that said plasma jet exhibits an enthalpy and temperature bringing about dissociation of said non-metallic element.

29. A process as defined in claim 1, characterized in that said plasma jet exhibits an enthalpy and temperature bringing about ionization of said non-metallic element.

30. A process as defined in claim 1, characterized in that an additional heating step is provided for said plasma jet following said high-current arc generating said plasma jet.

31. A process as defined in claim 30, characterized in that said additional heating is carried out by a high-frequency coupling into said plasma jet.

32. A process as defined in claim 1, characterized in that said chemical compound includes a metal.

33. A process as defined in claim 1, characterized in that said chemical compound exhibits in the region of its melting temperature a free enthalpy of formation lying in the region of zero and above.

34. A process as defined in claim 1, characterized in that said chemical compound is heated in said plasma jet to at least approximately 500 degrees C.

35. A process as defined in claim 1, characterized in that said coating of ceramic material comprises a catalytically active coating.

36. A process as defined in claim 1, characterized in that said coating of ceramic material comprises an electro-catalytically active coating.

37. A process as defined in claim 1, characterized in that said coating of ceramic material comprises a tribologically active coating.

38. A process as defined in claim 1, characterized in that said coating of ceramic material comprises a superconductive coating.

39. A process as defined in claim 1, characterized in that said plasma spraying is carried out with an ultrasonic jet.

40. A process as defined in claim 1, characterized in that said primary plasma gas comprises additional gases for increasing the viscosity of said primary plasma gas.

41. A process for applying a coating of ceramic material to a substrate by plasma spraying, wherein a material forming the coating of ceramic material is added to a plasma jet as a material to be sprayed, comprising the steps of:

providing a plasma torch;

introducing a primary plasma gas, comprising argon and additional gas other than argon for increasing enthalpy and the viscosity of said plasma gas, to said plasma torch to produce a laminar plasma jet;

providing a material to be sprayed, said material including a chemcial compound having the property of decomposing at least partially when heated in an inert environment before reaching its melting point,